US006146676A

United States Patent [19]

Van Milders

[11] Patent Number: 6,146,676

[45] Date of Patent: Nov. 14, 2000

[54] METHOD AND INSTALLATION FOR THE PREPARATION OF MEALS AND/OR MEAL COMPONENTS

[75] Inventor: Jean Achille Celine Eugene Van Milders, Knokke, Belgium

[73] Assignee: Hot Cuisine Technologies, naamloze vennootschap, Belgium

[21] Appl. No.: 08/945,752

[22] PCT Filed: Mar. 11, 1997

[86] PCT No.: PCT/BE97/00031

§ 371 Date: Nov. 6, 1997

§ 102(e) Date: Nov. 6, 1997

[87] PCT Pub. No.: WO97/33794

PCT Pub. Date: Sep. 18, 1997

[30] Foreign Application Priority Data

Mar. 13, 1996 [BE] Belgium ..... 09600214

[51] Int. Cl.[7] ..... B65B 55/00

[52] U.S. Cl. ..... 426/392; 426/407; 426/410; 426/412; 99/467; 99/468; 99/470; 99/472

[58] Field of Search ..... 426/106, 112, 426/113, 114, 115, 129, 243, 392, 394, 404, 407, 410, 412, 520, 393; 99/467, 468, 470, 472

[56] References Cited

U.S. PATENT DOCUMENTS 5,421,138 6/1995 Muise et al. ..... 53/440

FOREIGN PATENT DOCUMENTS 8800094 10/1989 Belgium .
1525884 5/1968 France .
785795 11/1957 United Kingdom .
2059248 4/1981 United Kingdom .

*Primary Examiner*—Milton Cano
*Attorney, Agent, or Firm*—Bacon & Thomas PLLC

[57] ABSTRACT

A method for the preparation of meals and/or meal components is provided. The method includes the steps of storing base products in spaces provided therefor, pre-treating the base products, packing and vacuum drawing the obtained products, vacuum boiling the packed products, and storing the boiled products in a refrigerated storage room. The steps are realized substantially in this order. An apparatus for the preparation of meals and/or meal component according to this method is also provided.

13 Claims, 2 Drawing Sheets

METHOD AND INSTALLATION FOR THE PREPARATION OF MEALS AND/OR MEAL COMPONENTS

This application is 371 of PCT/BE97/00031 filed Mar. 11, 1997.

FIELD OF THE INVENTION

The present invention concerns a method for the preparation of meals or components thereof, as well as an apparatus for realizing the method.

More particularly, the invention relates to the preparation of so-called cold-fresh meals by a vacuum boiling technique, realized at an industrial level.

Still more particularly, the invention relates to a method for the mass production of meals and meal components prepared under vacuum which guarantees a constant quality of the product and allows the product to be kept refrigerated between 0 and 3° C. for a period from 14 to 35 days from the date of production.

SUMMARY OF THE INVENTION

The invention aims at offering a method with which meals or components of meals may be realized which may be served quickly and simply, via a given regeneration technique, as fresh and, from a culinary viewpoint, high standard meals. The method is directed to the distributors who present the meals to the consumers.

To this aim, the method according to the invention comprises the successive steps of: storing a base product in a space provided therefore; pretreating the base product; packing and vacuum drawing the obtained product; vacuum boiling the packed products; and, storing the boiled product in a refrigerated space, preferably refrigerated at a temperature of 0 to 3° C., whereby the above-mentioned process steps are mainly realized in this order.

This order of steps produces the effect that no crossing arises between the paths that are followed by the raw products, semi-finished and finished products, making the spreading of bacteria or other forms of pollution impossible.

According to an important characteristic, one or more intermediate refrigerations are realized to a temperature under 10° C., preferably 1 to 3° C. Preferably, at least one intermediate refrigeration is realized after the unpacking of the base products and/or after the pre-treatment of the base products. Such intermediate refrigeration offers the advantage that the keeping qualities of the finally obtained product are considerably ameliorated.

According to another important characteristic, the pre-treatment is realized in two separated zones: a warm zone, in which the warm processes are realized, and a cold zone. In this way, the products which are only treated cold during the pre-treatment are kept separate from the warm products. This benefits the keeping qualities of the products to be cold treated.

The invention also concerns an apparatus for realizing the above-mentioned method, the characteristics of which will be apparent upon review of the further description and appended drawings.

BRIEF DESCRIPTION OF THE DRAWINGS

In order to better show the characteristics according to the invention, preferred embodiments are described hereafter, as examples without any limitative character, with reference to the accompanying drawings, in which.

DETAILED DESCRIPTION OF THE PREFERRED EMBODIMENTS

Figure 1:
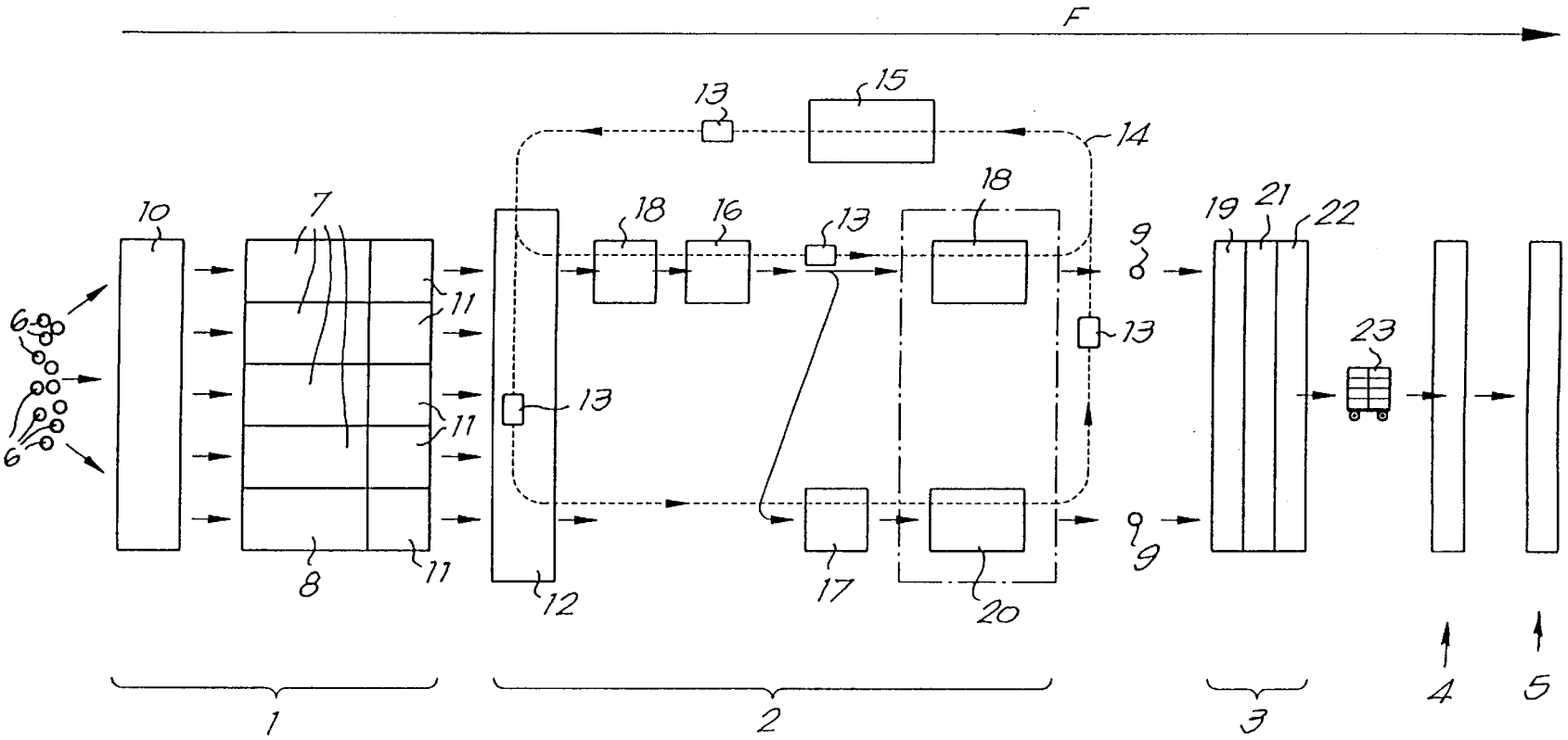
FIG. 1 represents, in a block-scheme, the method of the invention.

As represented in FIG. 1, the method according to the invention comprises five basic steps 1–5, respectively: storing base products 6 in spaces 7–8 provided therefor; pretreating base products 6; packing and vacuum drawing obtained products 9; vacuum boiling packed products 9; and storing boiled products 9, wherein the steps are realized substantially in this order according to a forward movement F.

Besides these basic steps 1–5, other optional steps may be realized, as described hereafter, which may be combined with each other or not.

Prior to the storage of base products 6 in spaces 7–8, as schematically represented with reference 10, the substantially raw ingredients may be inspected. Such inspection preferably comprises one or more operations, among which:

- control of characteristics agreed upon with the suppliers, with respect to freshness, quality, portioning, cut, agreed weight tolerances, etcetera;
- measurement of the temperature of delivered base products 6, preferably in the core;
- bacterial control;
- control of weight and nature of the ordered raw material according to order forms.

Base products 6 are stored in separated spaces 7–8 as a function of the nature of the product. Accordingly, at least a distinction is made between products which have to be conserved dry, products which have to be conserved refrigerated, but not deep-frozen, and products which have to be conserved deep-frozen. Base products 6 which have to be conserved dry are stored in separately defined space 8. For base products 6 which have to be conserved fresh, separate spaces 7 are used as a function of the nature of the product. So, for example, meat and fish products will be conserved separately from one another. Also, one of spaces 7 may be reserved for so-called non-food products, such as packing material and the like.

Base products 6 leave spaces 7 as they are required for the composition of meals or of specified components of meals. Hereby, weighing 11 may be done. Such weighing 11 does not necessarily have to be done for all products. Of importance, however, it is done for dry products because in most cases a very precise dosage thereof is needed.

In the above-mentioned pre-treating step 2, products 6 are pre-treated to obtain a semi-finished product 9.

Prior to or when starting this pre-treatment, base products 6 coming from spaces 7 are unpacked, insofar as they are provided with a packing. The unpacking preferably is realized in an unpacking zone 12 especially provided therefor, which preferably is air-conditioned. The packing materials such as glass, cardboard, plastics material and the like are removed and carried away.

Unpacked base products 6 are preferably stored in crates 13 forming a part of an internal crate system 14. Crates 13 circulate via a circuit and, when returning, pass along a washing-up station 15, where steps other than washing-up, such as disinfection, may be realized.

During the unpacking, base products 6, sorted into crates 13, are preferably provided with preparation guidelines, whereupon they are passed on to the correct next zone of production.

Subsequently a cold and/or warm treatment takes place as represented by corresponding zones, namely a cold zone 16 and a warm zone 17.

The cold zone is one which is air-conditioned at a temperature of approximately 12° C. Herein, base products 6, such as vegetables and the like, are washed and cut. Also the cold processing of other products such as fish, meat or poultry is carried out.

Hereby a first intermediate refrigeration 18 may be realized, whereby the cold pre-treated products are put in a refrigerating cell or the like. It is also possible to realize intermediate refrigeration 18 prior to the pre-treatment or, as represented in FIG. 1, prior to as well as after the pre-treatment.

The pre-treated products from the cold zone pass on either to a packing zone 19 or are processed in warm zone 17.

In warm zone 17 pre-treatments are carried out such as:

coloring pieces of meat and poultry, preferably without fat;

dressing soups and sauces, with or without previously determined garniture, whereby the latter may be dressed at a controlled low temperature and a controlled vacuum, and by so-called micro-cut apparatus and/or steam-injection apparatus, which offer a quick and efficient way of operation;

pre-steaming some well-defined ingredients, followed by a fast cooling-down;

mixing different ingredients and preparations;

pre-boiling;

freshing-up;

boiling and cooling-down;

emulsification;

boiling under pressure or vacuum.

According to the invention, the preparation in warm zone 17 is realized rapidly, so that the natural color, vitamins and minerals are preserved.

The whole may be controlled by a computer system, which contributes to full automatic cleaning after all steps effected during the above-mentioned pre-treatment.

The still slightly warm pre-treated raw material from the warm zone is preferably subjected to an intermediate refrigeration 20 in a cold buffer system and/or in fast refrigerating cells before undergoing its next operation.

Subsequently, obtained products 9 are packed. This is preferably done in an air-conditioned packing zone 19 with overpressure in which filtered air is blown. It is evident that the air-conditioning and/or realization of overpressure may also be applied to other places where other steps of the method are realized. The advantage is that pollution of whatever kind may be fully countered.

With the vacuum packing, all obtained products 9 which form the ingredients of a combination are brought together. Hereby, dosage systems and scales are used. Preferably, everything is packed in singular forms of packing having different measures. This may also be bulk packing.

The packing is realized by boil-proof foil.

The packed products are subsequently vacuum drawn, represented schematically in FIG. 1 with reference 21. This vacuum drawing is realized in so-called deep drawing lines.

After the vacuum drawing, each obtained product 9 is subjected to an inspection 22 which preferably comprises at least a metal detection and a weight control. Such inspection 22 allows the method to follow self-imposed quality standards and to operate under customer directed standards.

Subsequently, obtained products 9 are preferably stored on carts 23.

Thereupon, obtained products 9 are vacuum boiled, realized during the above-mentioned step 4. During this step, a fully computerized boiling and cooling-down process is realized.

The exact process is determined in advance by different parameters and product specifications which may be mentioned on a technical index.

The boiling process is realized in a boiling apparatus formed by autoclaves. Preferably, a steam supply, combined with a heat exchanger, is used such that control takes place by a valve regulating system so that for each product the exact steam pressure and steam temperature may be obtained.

Once the boiling process is finished, boiled products 9 are cooled down as fast as possible, preferably to a temperature of 1 to 3° C. in the core of the products.

The cooling-down is preferably carried out in two phases and is preferably realized in the autoclaves.

In order to determine the exact temperature and to guarantee an optimal cooling down, cooling-water is used, the temperature of which is regulated by guiding along an ice-buffer. The cooling-water may therefore be recycled because it is not polluted.

In the last step 5, refrigerated storage is realized. Hereby, the prepared products, which may be meals or parts of meals, are stored according to a so-called fifo (first in, first out) system.

According to the invention, the products are provided with thermal labels on which not only the name of the product is mentioned, but also all ingredients, the ultimate date of keeping qualities, admission numbers for export and data relating to the firm.

According to a special technique, the products are provided with striking signs which, after a determined period of time, preferably one week, are changed. These signs preferably consist of colors. More specifically, labels of different colors will be applied each week. This allows the customers to apply the so-called fifo system in an easy, controllable way.

Labelling and conservation takes place at low temperatures, for example 0 to 3° C. The products may be packed and loaded on trolleys or pallets, ready for transportation.

It is to be noted that this transportation preferably should also be done at a temperature of 1 to 3° C. The transporters may be controlled to that end by automatically operating units which constantly register the temperature. These so-called loggers are adjusted in advance and are packed at random between the products. The respective customer is informed about this and must return the loggers to the producer of the meals. A computer printout of the registered data with date, hour and temperature, allows perfect control.

Subsequently to the above-mentioned process, it is intended that the customer buying the products will store the products in a refrigerating cell at a temperature of 0 to 3° C., awaiting their use.

Figure 2:
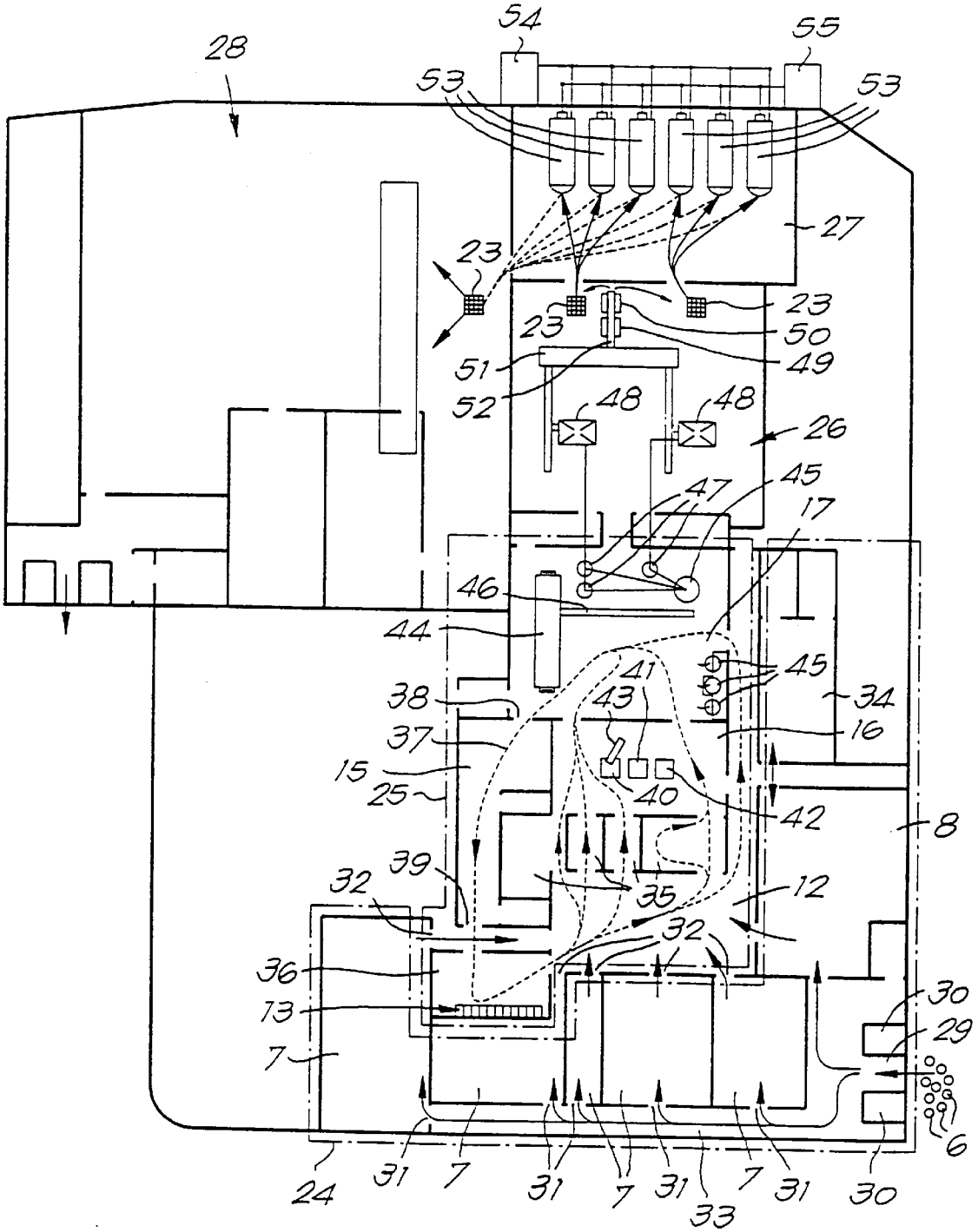
FIG. 2 schematically represents an apparatus for realizing the method shown in FIG. 1.

In order to realize the above-mentioned method, use may be made of an apparatus, as represented in FIG. 2, comprising an industrial space with a very specific technical construction.

The apparatus comprises a storage zone 24; a pre-treatment zone 25; a packing and vacuum drawing zone 26; a boiling zone 27; and an end storage zone 28 for the finished products. These zones are arranged in successive communication so that no crossing may occur between the different semi-finished products. Thus, the transfer of bacteria is eliminated, or at least reduced to a minimum.

The application of this apparatus is described hereafter together with the different components of the apparatus.

Base products 6 are delivered at an entry 29. Areas 30 are provided at entry 29 for entry controls which determine which spaces 7–8 base products 6 are stored as a function of the nature of the product.

Base products 6 then arrive in storage zone 24. Spaces 7–8 are situated in storage zone 24. Spaces 7–8 may be refrigerating rooms as well as freezing rooms.

Spaces 7–8 are located next to each other and each is provided with a space entry 31 and an opposing space exit 32. Space entries 31 are connected to entry 29 via a passage 33 or the like. Space exits 32 face pre-treatment zone 25.

Space 8, in which the dry material is kept, is connected to a weighing room 34 in which the dry material, and possibly other components of the meals to be combined, may be weighed.

The weighed raw material may be put on carts and provided with the necessary numbered tickets, badge numbers and other indicators.

Pre-treatment zone 25 is substantially and successively divided into unpacking zone 12, refrigerating cells 35 for the above-mentioned intermediate refrigeration, cold zone 16 and warm zone 17.

Hereby base products 6, according to the production planning, are taken from spaces 7–8 and, insofar as necessary, unpacked in unpacking zone 12. Unpacked base products 6 are then loaded in crates 13 or in trays. Crates 13 originate from a storehouse 36. Crates 13 with unpacked base products 6 thereupon undergo an intermediate refrigeration by putting them in refrigerating cells 35.

Washing-up station 15 is located in the immediate vicinity of zones 16–17. All used crates 13 and possibly other receptacles return through washing-up station 15 back to storehouse 36 via a circuit 37. Washing-up station 15 hereby shows station entry 38 which, according to the direction of movement followed by the products, is located behind refrigerating cells 35 and a station exit 39 which, according to the direction of movement, is located before refrigerating cells 35.

Cold zone 16, which may also be called a cold kitchen, is provided with an air-conditioning device which ensures that the air blown therein is filtered and that the temperature in this zone is kept almost constantly at 12° C.

In cold zone 16, various devices are located, preferably a vegetable washing machine 40, a cutting machine 41 having a three-dimensional cutting mechanism, and an emulsification system 42.

According to the invention, vegetable washing machine 40 is used to wash vegetables by turbulent water. As opposed to the classical vegetable washing machine where the vegetables are weighed in water, this technique using turbulent water, which is totally new, offers the very important advantage that the vegetables may be washed in minimal time. In particular, washing machine 40 may be made free from sand. Vegetable washing machine 40 is preferably provided with a lift-bridge 43 which ensures that the vegetables are placed in special trays for further transportation in the apparatus.

Depending on the preparation to be carried out, the vegetables are cut in cutting machine 41, according to the specifications of the accompanying technical index.

In emulsification system 42, certain raw material is processed. Other raw material may be further prepared by other machines, not represented, before shifting to the next step in the process.

In warm zone 17, a part of base products 6 processed in cold zone 16 as well as a quantity of unprocessed base products 6 from storage zone 24 are processed.

A pre-treatment apparatus 44 is provided to carry out the various treatments in warm zone 17 as listed above. The preparation and dosage of soups and sauces occurs in a schematically represented preparation/dosage apparatus 45. This preparation and dosage is, according to the invention, fully computer-controlled. As a result, an optimal product from the viewpoint of quality and with the best return is produced.

Semi-finished products 9 from warm zone 17 shift via one or more conveyor belts 46, or the like, to either a buffer tank 47, whereby different buffer tanks may be provided for different products, or packing and vacuum drawing zone 26.

Operations in packing and vacuum drawing zone 26 occurs under strict hygienic conditions. Therefore, an arrangement is provided to blow sterile, filtered air in this zone with a slight overpressure and a temperature which is kept at almost 12° C. so as to avoid bacterial growth as much as possible.

A packing and deep-drawing apparatus 48, at least one metal detecting apparatus 49 and at least one weight controlling apparatus 50 for the control of the weight are located in packing and vacuum drawing zone 26.

In packing and deep-drawing apparatus 48, semi-finished products 9 are packed in flexible packing, preferably automatically.

Semi-finished products 9 coming from packing and deep-drawing apparatus 48 are brought on one line by a specially defined sorting mechanism 51. This sorting mechanism uses different belts running side by side at different speeds in such way that semi-finished products 9 from packing and deep-drawing apparatus 48 end up one by one on a mutual conveyor belt 52, or the like.

The unique aspect of sorting mechanism 51 may be found in that different sizes of semi-finished products 9 may be packed in a prompt way because the resulting difference in speed of the packing and deep-drawing apparatus does not constitute a disadvantage in the further processing.

Packed products 9 then pass through a metal detecting apparatus 49 which ensures that each packing in which metal is found is automatically pushed out and preferably a light and/or sound signal is given simultaneously. The metal detection is based on a magnetic control.

Weight controlling apparatus 50 ensures that a control is effected on the weight, taking into consideration the fixed parameters. Packed products 9 which do not meet the fixed weight are also pushed out.

Subsequently, approved packed products 9 are stored on carts 23 which are brought to boiling zone 27.

Boiling apparatus 53 composed of autoclaves is located in boiling zone 27 into which loaded carts 23 may be driven.

In these autoclaves, as mentioned above, a boiling and a subsequent cooling-down is effected.

During this process the autoclaves are completely locked. This process, which is commanded by a PLC-controlled program, successively provides a boiling period under pressure in a heating-up phase, a first cooling-down phase by cooling water and a second cooling-down phase by ice water. Boiling apparatus 53 is connected to a steam production element 54 on the one hand and a cooling water system 55 on the other hand.

Finally the boiled products are stored in end storage zone 28.

Preferably the whole apparatus is fully computerized.

The full process is preferably provided with a control system having different control points which ensure that the products which leave the apparatus incorporate all guarantees with regard to organoleptic as well as bacterial quality.

To this end, preferably a so-called H.A.C.C.P.-system (Hazard Analysis and Critical Control Points) is used.

The present invention is in no way limited to the embodiments as described and as represented in the figures, but such method and apparatus for the preparation of meals or components of meals may be realized in various variants without leaving the scope of the invention.

What is claimed is:

1. A method for the preparation of meals and/or meal components, comprising the sequential steps of: storing base products in spaces provided therefor; pre-treating the base products; packing and vacuum drawing the obtained products; vacuum boiling the packed products; and refrigerating and storing the boiled products in a refrigerated storage room, wherein at least a number of the products are subjected to at least one intermediate refrigeration in addition to the refrigeration of the boiled products and wherein the at least one intermediate refrigeration is at a temperature of 1 to 3° C.

2. The method according to claim 1, wherein the at least one intermediate refrigeration is selected from the group consisting of:

an intermediate cooling which precedes the pre-treatment, an intermediate refrigeration which is carried out after the pre-treatment, an intermediate refrigeration in fast refrigeration cells which is carried out on products which were heated pursuant to the pre-treatment, and an intermediate refrigeration in a refrigerating buffer system with buffer tanks which is carried out on products which were heated pursuant to the pre-treatment, and any combination thereof.

3. The method according to claim 1, wherein the base products are stored in separated spaced as a function of the nature of the products.

4. The method according to claim 1, wherein an internal crate system is used to move the products through a pre-treatment zone.

5. The method according to claim 1, wherein the base products contain at least some vegetables and at least a number of the vegetables are washed by turbulent water.

6. The method according to claim 1, wherein the obtained products are subjected to a metal detection in order to sort out products containing metal after having been vacuum packed.

7. The method according to claim 1, wherein the obtained products are subjected to a weight control after having been vacuum packed.

8. The method according to claim 1, wherein the packed products are boiled in a boiling apparatus comprising an autoclave and are subsequently cooled to a predetermined temperature while still remaining in the boiling apparatus.

9. The method according to claim 8, wherein the subsequent cooling is realized first by cooling water and subsequently by ice water until the products reach a temperature of 1 to 3° C.

10. A method for the preparation of meals and/or meal components, comprising the sequential steps of: storing base products in spaces provided therefor; pre-treating the base products; packing and vacuum drawing the obtained products; vacuum boiling the packed products; and storing the boiled products in a refrigerated storage room, wherein the pre-treatment of the base products is carried out in two separate zones including a cold zone where the base products are treated cold and a warm zone where a number of treatments are effected at a relatively higher temperature and wherein at least one zone is air-conditioned and overpressured such that a temperature of approximately 12° C. and an overpressure are maintained.

11. The method according to claim 10, wherein the air-conditioning and overpressuring are at least applied in a cold zone where the base products are pre-treated cold and in a packing zone where the obtained products are packed under vacuum.

12. An apparatus for the preparation of meals and/or meal components comprising: a storage zone; a pre-treatment zone; a packing and vacuum drawing zone; a boiling zone; and an end storage zone for finished products, wherein at least the pre-treatment zone, the packing and vacuum drawing zone and the boiling zone are separate zones arranged to be individually conditioned and each of the zones is successively arranged to communicate with the preceding zone such that the individual conditioning is maintained.

13. An apparatus according to claim 12, wherein the storage zone includes spaces in which different base products are stored separately according to their nature, the spaces being provided with opposed entries and exits, the entries communicating with a supply entry for the supply of products, the exits communicating with the pre-treatment zone; the pre-treatment zone includes an unpacking zone located immediately behind the spaces, a plurality of refrigerating cells in conjunction with the unpacking zone, a cold zone for the cold pre-treatment of base products and a warm zone subsequent to the cold zone for warm pre-treatment of base products; the packing and vacuum drawing zone includes a packing and deep-drawing apparatus; the boiling zone includes a boiling apparatus connected to a steam production element and connected to a cooling water system; and the end storage zone is a room in which finished products are conserved in a refrigerated condition.

* * * * *